United States Patent [19]

Aime

[11] Patent Number: 5,056,628

[45] Date of Patent: Oct. 15, 1991

[54] APPARATUS AND METHOD FOR PROCESSING CALLS ENTERED IN ELEVATOR CARS

[75] Inventor: Michel Aime, Elancourt, France

[73] Assignee: Inventio AG, Switzerland

[21] Appl. No.: 550,394

[22] Filed: Jul. 10, 1990

[30] Foreign Application Priority Data

Jul. 11, 1989 [CH] Switzerland ..... 02583/89

[51] Int. Cl.[5] ..... B66B 1/18

[52] U.S. Cl. ..... 187/127

[58] Field of Search ..... 187/127, 121, 128, 130, 187/138

[56] References Cited

U.S. PATENT DOCUMENTS 4,355,705 10/1982 Schröder et al. ..... 187/127
4,555,000 11/1985 Umeda ..... 187/127
4,691,808 9/1987 Nowak et al. ..... 187/125

FOREIGN PATENT DOCUMENTS 0246395 10/1987 European Pat. Off. .
2141261 12/1984 United Kingdom .

*Primary Examiner*—A. D. Pellinen
*Assistant Examiner*—W. E. Duncanson, Jr.
*Attorney, Agent, or Firm*—Marshall & Melhorn

[57] ABSTRACT

An elevator group control with immediate allocation of floor calls includes an apparatus for processing car calls according to a car call algorithm implemented in a process computer in dependence on the traffic volume, the position of the calls, and the immediately allocated floor calls. Floor calls allocated by a floor call algorithm are entered for each elevataor car in a first list of the current one half round trip and/or in a second list of the next one half round trip. Both lists are stored in a memory region common to the algorithms. In the case of low traffic volume, car calls lying ahead of the elevator cars are entered into the first list unconditionally and car calls lying behind are entered into the second list subject to a maximum trip distance. In the case of average traffic volume, car calls lying ahead are entered into the first list in case synonymous allocated calls are already present therein. Otherwise, these calls are entered into the second list as also are the car calls lying behind subject to the maximum trip distance. In the case of high traffic volume, an entry takes place into the first and second lists only in case synonymous allocated calls are entered and the maximum trip distance is not exceeded.

19 Claims, 8 Drawing Sheets

| | START | END |
|---|---|---|
| | 3 | 7 |
| KR5 → | 3 | 5 |
| KR6 → | 3 | 6 |

1

2

| START | END |
|---|---|
| 6 | 2 |
| | |
| | |

| START | END |
|---|---|
| 3 | 7 |
| 4 | 7 |
| 3 | 7 |
| 3 | 7 |
| | |

KR5 →
KR6 →

1

2

| START | END |
|---|---|
| 7 | 2 |
| 4 | 0 |
| 2 | 1 |
| 7 | 6 |
| 7 | 5 |

KR6 →
KR5 →

| | START | END |
|---|---|---|
| | 3 | 5 |
| | 3 | 7 |
| | 4 | 7 |
| | 4 | 7 |
| KR5 → | 3 | 5 |
| KR6 → | 3 | 7 |

1

2

| | START | END |
|---|---|---|
| | 7 | 3 |
| | 6 | 2 |
| | 6 | 2 |
| | 6 | 1 |
| KR6 → | 7 | 6 |
| | | |

APPARATUS AND METHOD FOR PROCESSING CALLS ENTERED IN ELEVATOR CARS

BACKGROUND OF THE INVENTION

The present invention relates generally to elevator system controls and, in particular, to an apparatus and a method for the processing of destination calls entered in elevator cars of an elevator group with immediate allocation of the calls entered at the floors.

A destination call control with floor call transmitters and car call transmitters for a plural elevator group is shown in U.S. Pat. No. 4,555,000. The floor call transmitters include destination buttons for registering the floor calls and the calls for the destination from the floor which calls are assigned to the cars. The allocated floor calls are indicated in the elevator cars. Calls entered in the cars are registered immediately and served without regard to the allocated floor calls. The disadvantage of this type of control is that the optimization of the elevator group performance capability, which is achieved by the immediate allocation of calls, is impaired by serving the car calls without regard to the allocated floor calls.

SUMMARY OF THE INVENTION

The present invention solves the above identified problem of optimization by processing the car calls without effect on the improved utilization of the elevator installation achieved by the immediate allocation of the floor calls. The advantages achieved by the invention are that the wishes of a minority of users are taken into consideration, that the degree of knowledge about the utilization of the elevator group is improved with targeted user information and that inexperienced users can autodidactically acquire the knowledge required to operate elevator installations with immediate allocation of calls.

The present invention concerns a method and apparatus for processing destination calls entered in call registering devices in elevator cars of an elevator group, the cars having elevator controls with immediate allocation of destination calls entered on the floors served by the cars. The method includes the steps of determining a value of the traffic volume of an elevator group from previously allocated destination calls; determining a trip distance from the position of a car destination call to be processed with respect to an elevator car of the elevator group in which said car destination call was entered., comparing the car destination call with any destination calls allocated to the elevator car to determine coincidence; and determining whether and when the car destination call is to be served by the elevator car based upon the value of traffic volume, the trip distance and any coincidence of the car destination call with a destination call allocated to the elevator car. In a low traffic volume, if the car destination call lies ahead of the elevator car, the call is served unconditionally and, if the call lies behind the elevator car, the call is served if the trip distance is less than a predetermined maximum trip distance. In an average traffic volume, if the car destination call lies ahead of the elevator car, the call is served if the coincidence exists, and if the coincidence does not exist or the call lies behind the elevator car, the call is served if the trip distance is less than a predetermined maximum trip distance. In a high traffic volume, the car destination call is served only when the coincidence exists and the trip distance is less than a predetermined maximum trip distance.

The apparatus includes a computer connected with the floor call registering devices, with the floor call indicating devices, with the car call registering devices, with the car call indicating devices and with the elevator controls of an elevator group. A first algorithm implemented in the process computer controls the allocation of the calls entered on the floors. A second algorithm also implemented in the process computer controls the processing of the calls entered in the elevator cars. Both algorithms have free access to a common memory area in the process computer where the allocated calls are stored.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

For the sake of greater clarity, the names of the algorithms and the names of the devices shown in the FIGS. 1 to 5, as well as the abbreviations listed in the column "Memo-code" of the Table 1 below, are used as reference symbols in the following description of the present invention. In the FIGS. 6 to 10, method steps are illustrated in which tests are conducted as to whether constants, status variables or variables positively or negatively fulfil the conditions set forth in triangular areas. A positive result of a test is characterized by the reference symbol Y and a negative result of a test is characterized by the reference symbol N in the respective step.

Figure 1:
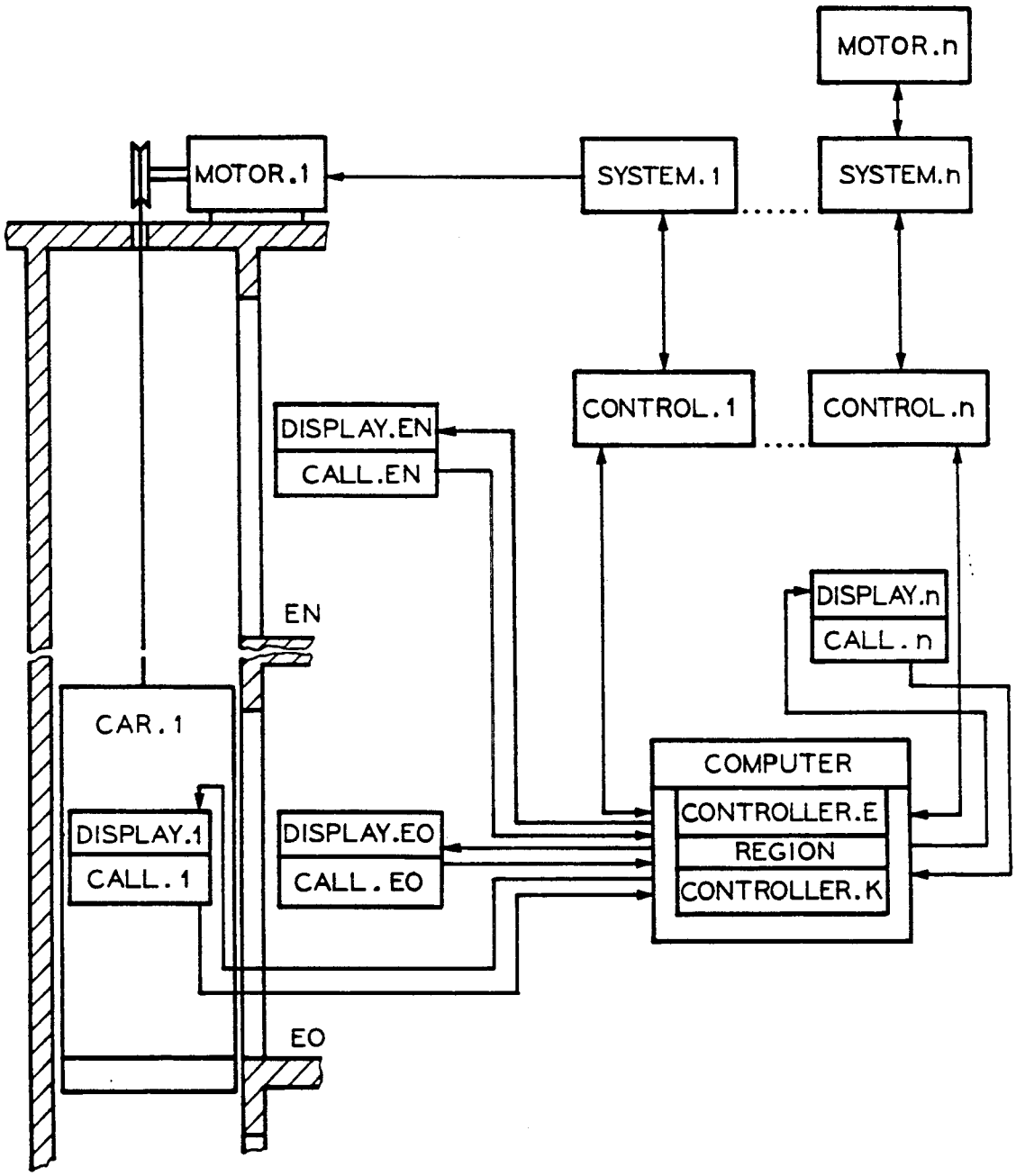
FIG. 1 is a partial schematic and partial block diagram of an elevator group control according to the present invention.

An elevator group, consisting of elevators designated "1" to n serving the floors EO to EN, is illustrated in the FIG. 1. Floor call registering devices CALL.EO to CALL.EN and floor call indicating devices DISPLAY.EO to DISPLAY.EN are provided on the floors EO to EN respectively. A hoist machine denoted by MOTOR.1 drives an elevator car CAR.1 of the elevator "1". The hoist machine MOTOR.1 is supplied with electrical energy by a drive system SYSTEM.1 which is controlled by an elevator control CONTROL.1. A car call registering device CALL.1 and a car call indicating device DISPLAY.1 are located in the elevator car CAR.1. The other elevators in the group are similar to the elevator "1" and are represented by the elevator "n" with a hoist machine MOTOR.n, a drive system SYSTEM.n, an elevator control CONTROL.n and an elevator car CAR.n (not shown) having a car call registering device CALL.n and a car call indicating device DISPLAY.n.

A process computer COMPUTER is connected with the floor call registering devices CALL.EO to CALL.EN, with the floor call indicating devices DISPLAY.EO to DISPLAY.EN, with the car call registering devices CALL.1 to CALL.n, with the car call indicating devices DISPLAY.1 to DISPLAY.n and with the elevator controls CONTROL.1 to CONTROL.n. An algorithm CONTROLLER.E implemented in the process computer COMPUTER controls the allocation of the calls entered on the floors EO to EN. An algorithm CONTROLLER.K also implemented in the process computer COMPUTER controls the processing of the calls entered in the elevator cars CAR.1 to CAR.n. Both algorithms have free access to a common memory area REGION in the process computer in which the allocated calls and other information is stored.

Figures 2A, 2B, 2C:
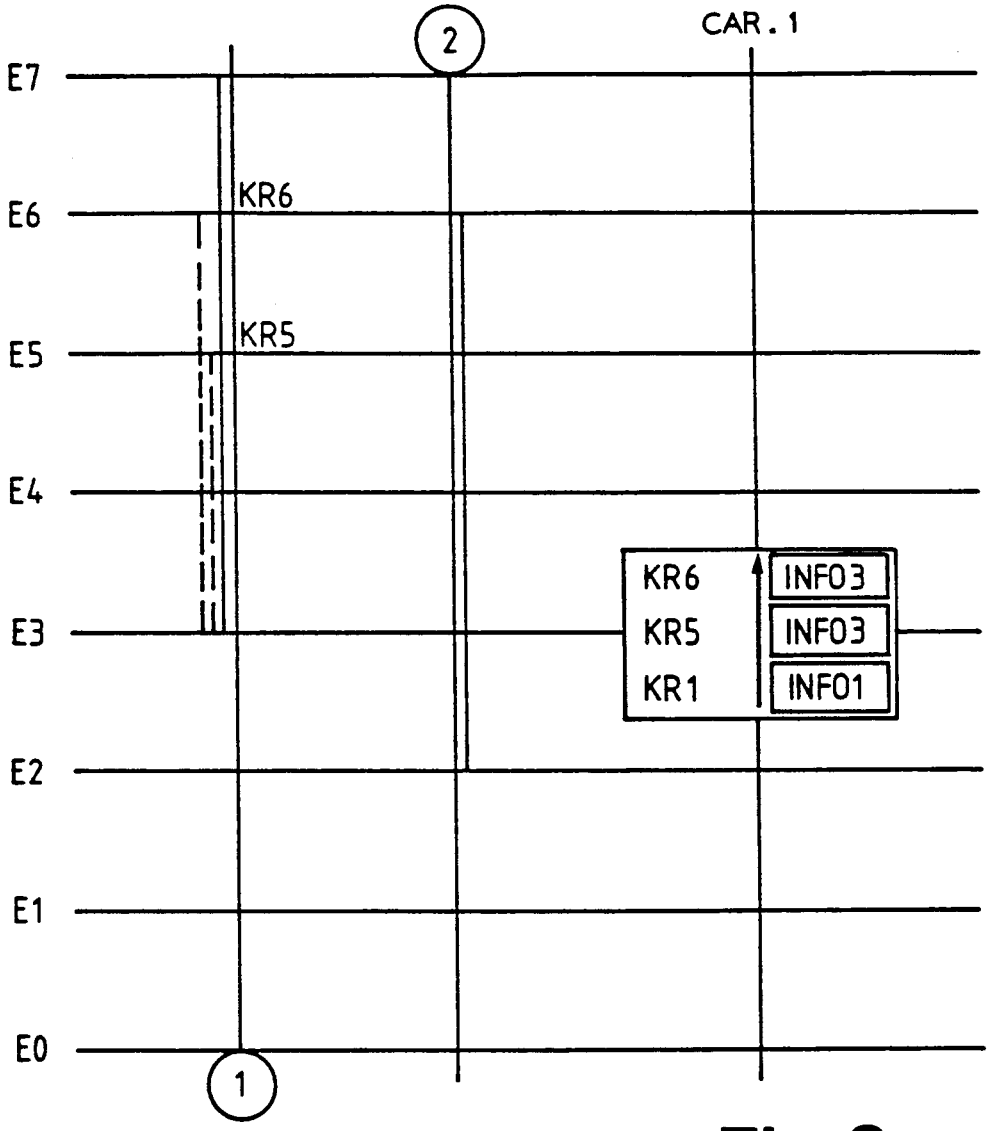
FIG. 2*a* is a schematic diagram of the operation of the control of FIG. 1 utilizing the method according to the present invention in the case of low traffic volume.
FIGS. 2*b* and 2*c* are a tabular illustration of the elevator car trips shown in FIG. 2*a;*
Figures 3A, 3B, 3C:
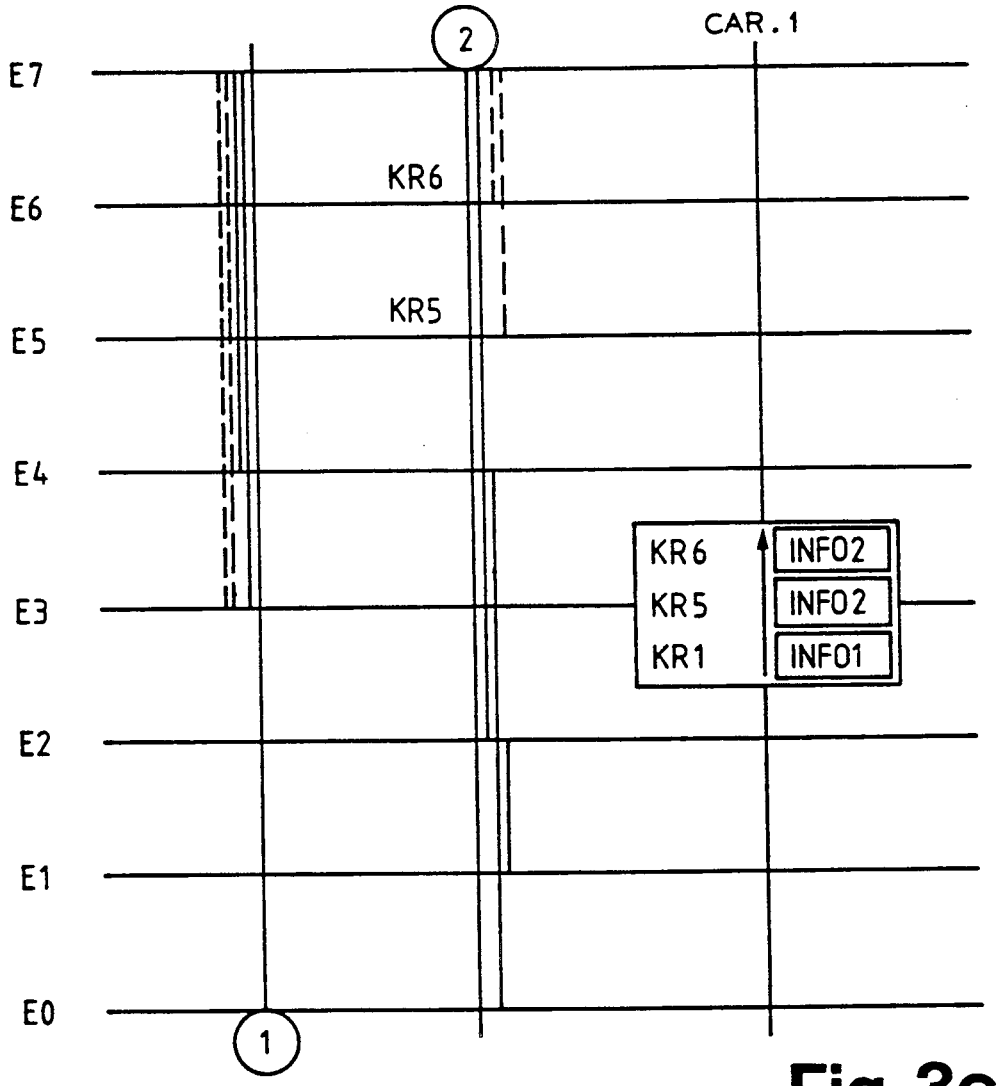
FIG. 3*a* is a schematic diagram of the operation of the control of FIG. 1 utilizing the method according to the present invention in the case of average traffic volume.
FIGS. 3*b* and 3*c* are a tabular illustration of the elevator car trips shown in FIG. 3*a;*
Figures 4A, 4B, 4C:
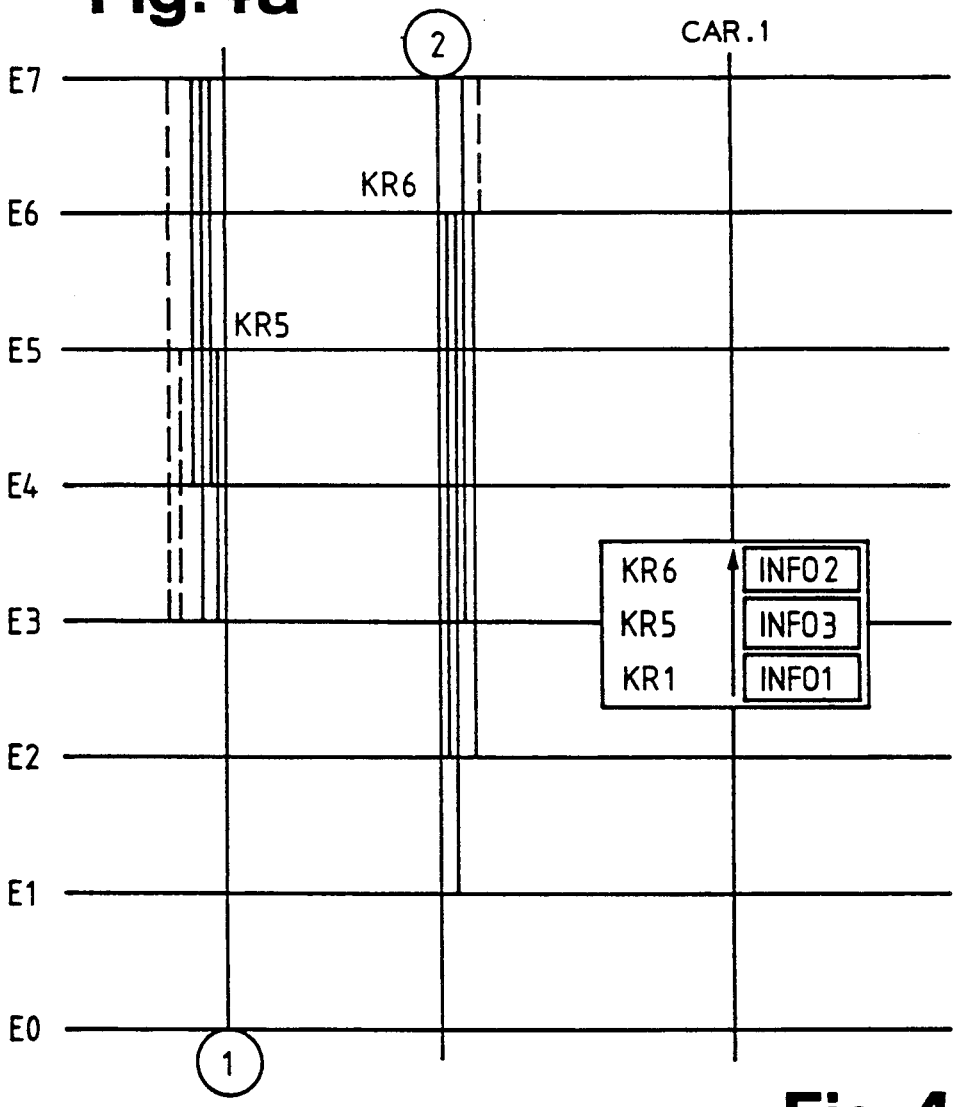
FIG. 4*a* is a schematic diagram of the operation of the control of FIG. 1 utilizing the method according to the present invention in the case of high traffic volume.
FIGS. 4*b* and 4*c* are a tabular illustration of the elevator car trips shown in FIG. 4*a;*

An example of the method according to the present invention, utilizing an elevator group with the floors EO to E7, is illustrated in the FIGS. 2*a*, 3*a* and 4*a*. The car calls KR1, KR5 and KR6 are entered in the elevator car CAR.1 on the floor E3. The number in the car call reference symbol indicates the destination floor. For example, the car call KR1 indicates a car call for the destination floor E1. An upwardly pointing arrow symbolizes the direction of travel of the elevator car CAR.1. The number "1" framed by a circle designates a list in which the allocated floor calls of the current one half round trip are entered numerically as shown in the FIGS. 2*b*, 3*b* and 4*b*. The number "2" framed by a circle designates a list in which the allocated floor calls of the next one half round trip are entered numerically as shown in the FIGS. 2*c*, 3*c* and 4*c*. In the following, these reference symbols are referred to as Circle 1 and Circle 2 respectively. Allocated floor calls are illustrated by solid lines and processed car calls by broken lines in the FIGS. 2*a*, 3*a* and 4*a*. Both kinds of calls are entered numerically as trips in the list Circle 1 and the list Circle 2 in the columns START/END shown in the FIGS. 2*c*, 3*c* and 4*c*. At the end of the current one half round trip, the list Circle 1 is cleared of its contents and used for entries of the next one half round trip. At the same time, the list of trips Circle 2 is made into the list Circle 1 of the current one half round trip.

TABLE 1

| Memo-code | |
|---|---|
| | Constant |
| INFO1 | Call will not be served, please step out and enter call anew |
| INFO2 | Call will be served in the opposite direction of travel |
| INFO3 | Call will be served |
| MDT | Maximum trip distance |
| | Status Variable |
| RDC | Direction of travel of car |
| RSC | Data offer by car |
| OP1 | Operator 1 |
| OP2 | Operator 2 |
| | Variable |
| ASC | Allocation of car |
| CPO | Position of car |
| DCC | Destination call from car |
| DCF | Destination call from floor |
| DSN | Destination |
| DST | Trip distance |
| FST | First Start |
| LDN | Last Destination |
| STT | Start |
| TRF | Traffic Volume |

The processing of the car calls KR1, KR5 and KR6 in the case of low traffic volume is explained with the aid of the FIGS. 2*a*, 2*b* and 2*c*. The list Circle 1 of the current one half round trip includes a previously allocated trip from the floor E3 to the floor E7. A previously allocated trip from the floor E6 to the floor E2 requested by a floor call is entered into the list Circle 2 of the next one half round trip. The trips which are requested by the car calls KR5 and KR6 and lie ahead of the elevator car CAR.1, from the E3 to the floor E5 or E6, are unconditionally entered into the list Circle 1 and served. Immediately upon the entry of the car calls KR5 and KR6, the user information INF03 with the text "Call will be served" is generated at the car display by the computer. The car call KR1, lying behind the elevator car CAR.1, is not served since that trip would be across more than an allowable number of floors, such as eight floors in the present example. Immediately upon the entry of the car call KR1, the user information INFO1 with the text "Call will not be served, please step out and enter call anew" is generated by the COMPUTER at the car display in the associated elevator car.

The processing of the car calls KR1, KR5 and KR6 in the case of average traffic volume is explained with the aid of the FIGS. 3*a*, 3*b* and 3*c*. The list Circle 1 of the current one half round trip includes a trip E3/E7 and a trip E4/E7, and the list Circle 2 of the next one half round trip includes a trip E7/E2, a trip E4/EO and a trip E2/E1. The trips E3/E5 and E3/E6 requested by the car calls KR5 and KR6 are treated with second priority and are served only in the opposite direction of travel in case the trip does not thereby pass more than eight floors in the present example. In the case of average traffic volume, a trip distance of six floors thus results for KR5 and of five floors for KR6. The list Circle 1 is augmented by one trip E3/E7, and the list Circle 2 by one trip E7/E5 and one trip E7/E6. Immediately upon the entry of the car calls KR5 and KR6, the user information INF02 with the text "call will be served in the opposite direction of travel" is generated by the COMPUTER at the car display. Although E1 is a stopping floor, KR1 is not served, because the trip E3/E7/E1 crosses more than eight floors. Immediately upon the entry of the car call KR1, the user information INFO1 with the text "call will not be served, please step out and enter call anew" is generated at the car display.

The processing of the car calls KR1, KR5 and KR6 at high traffic volume is explained with the aid of the FIGS. 4*a*, 4*b* and 4*c*. The list Circle 1 of the current one half round trip includes the trips E3/E5, E3/E7, E4/E7 and E4/E7. The trips E7/E3, E6/E2, E6/E2 and E6/E1 are entered in list Circle 2 of the next one half round trip. The trips E3/E5 and E3/E6 requested by the car calls KR5 and KR6 respectively are served only when the corresponding stopping floors are already entered in the list Circle 1 or in the list Circle 2. In the present example, E5 is a stopping floor entered in the list Circle 1 and E6 is a stopping floor entered in the list Circle 2. Immediately upon the entry of the car call KR5, the user information INF03 with the text "Call will be served" is generated at the car display. Immediately upon the entry of the car call KR6, the user information INF02 with the text "Call will be served in the opposite direction of travel" is generated. For the performance of the trip E3/E6 in the opposite direction of travel, the same restriction applies as for average traffic volume in that it is only served when no more than eight floors lie between START and END. In order for the destination call control to take into consideration the additional traffic volume, the list Circle 1 is augmented by a trip E3/E5 and a trip E3/E7, and the list Circle 2 is augmented by a trip E7/E6. The same conditions apply to the processing of the car call KR1, namely the entered stopping floor and a trip no longer than eight floors. Both conditions are not fulfilled in the present example, which leads to the immediate generation of the user information INFO1 with the text "Call will not be served, please step out and enter call anew" at the car display.

Figure 5:
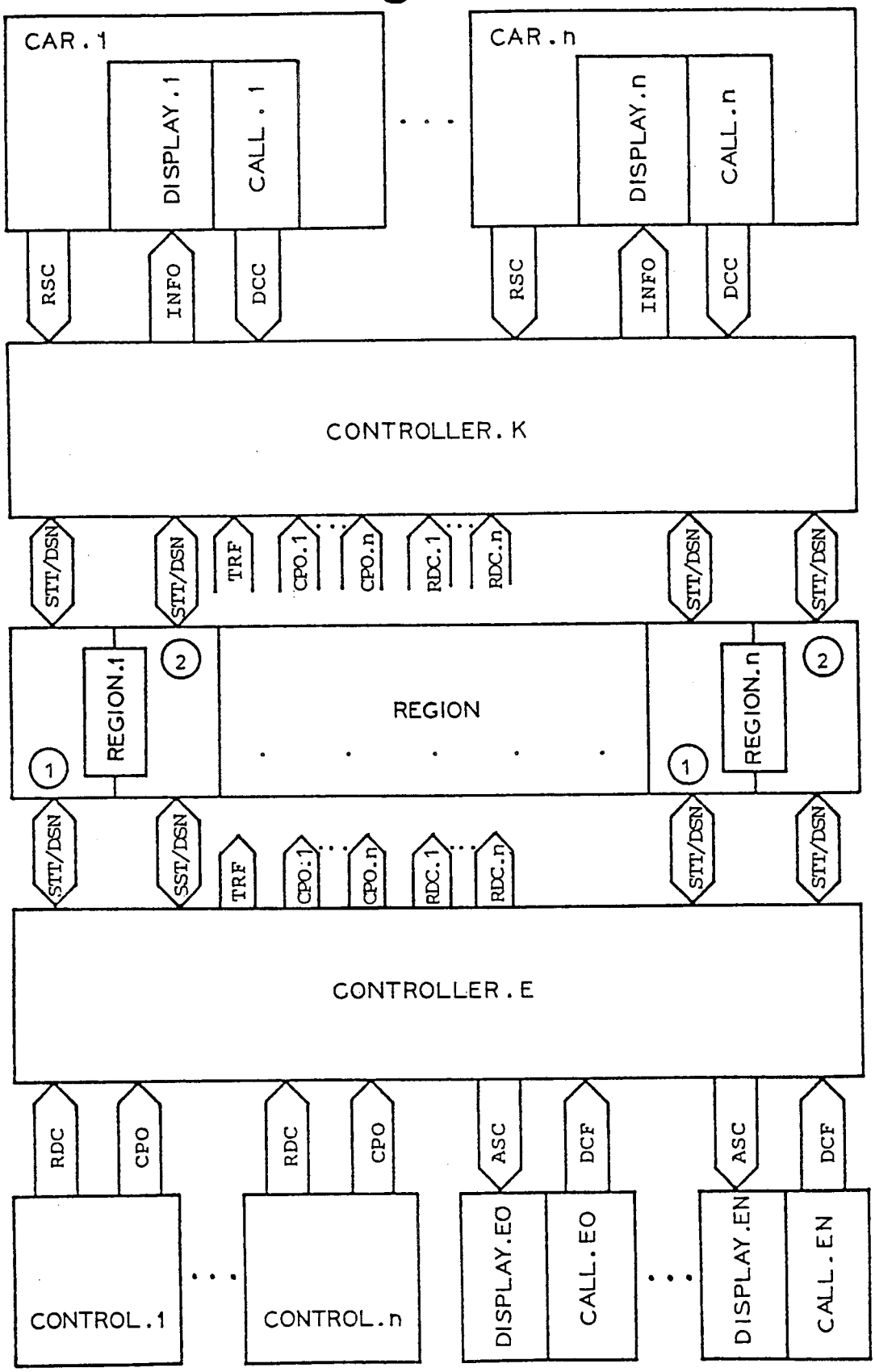
FIG. 5 is a block diagram of the data sources and data sinks utilized in the control of FIG. 1 and the method according to the present invention.

The data sources and data sinks involved in the apparatus and method according to the present invention are illustrated in the FIG. 5. The algorithm CONTROLLER.E implemented in the process computer COMPUTER controls the allocation of the destination calls DCF entered by means of the floor call registering devices CALL.EO to CALL.EN on the floors EO to EN respectively. Car allocations ASC are communicated to the users on the floors by means of the floor call indicating devices DISPLAY.EO to DISPLAY.EN and passed onto the elevator controls CONTROL.1 to CONTROL.n. Allocated calls are indicated in the elevator cars CAR.1 to CAR.n by means of devices which are not shown.

The elevator controls CONTROL.1 to CONTROL.n generate the directions of travel of the cars RDC and the car positions CPO according to the algorithm CONTROLLER.E. The algorithm CONTROLLER.K, which controls the processing of destination calls DCC entered in the elevator cars CAR.1 to CAR.n by means of the car call registering devices CALL.1 to CALL.n respectively, receives the traffic volume TRF, the car positions CPO.1 to CPO.n and the directions of travel of the cars RDC.1 to RDC.n from the algorithm CONTROLLER.E. The algorithm CONTROLLER.K processes the car destination calls DCC independently of the received car travel directions RDC and of the received car positions CPO. The data exchange between the elevator cars CAR.1 to CAR.n and the algorithm CONTROLLER.K is initiated by the car data offer RSC status variable.

According to the type of processing of the car destination calls DCC, reports INFO1 to INF03 are generated to the car call indicating devices DISPLAY.1 to DISPLAY.n. For each partial region, there is provided a list Circle 1 and a list Circle 2 in which the allocated destination calls of the current one half round trip and next one half round trip are entered in the form of START/END STT/DSN. The lists are read or updated by the algorithm CONTROLLER.E as well as by the algorithm CONTROLLER.K. In addition, the algorithm CONTROLLER.E controls the transfer from one list to the other list at the end of each one half round trip so that the list of the next one half round trip becomes the list of the current one half round trip and the list of the current one half round trip is cleared of its contents and becomes the list of the future next one half round trip.

Figure 6:
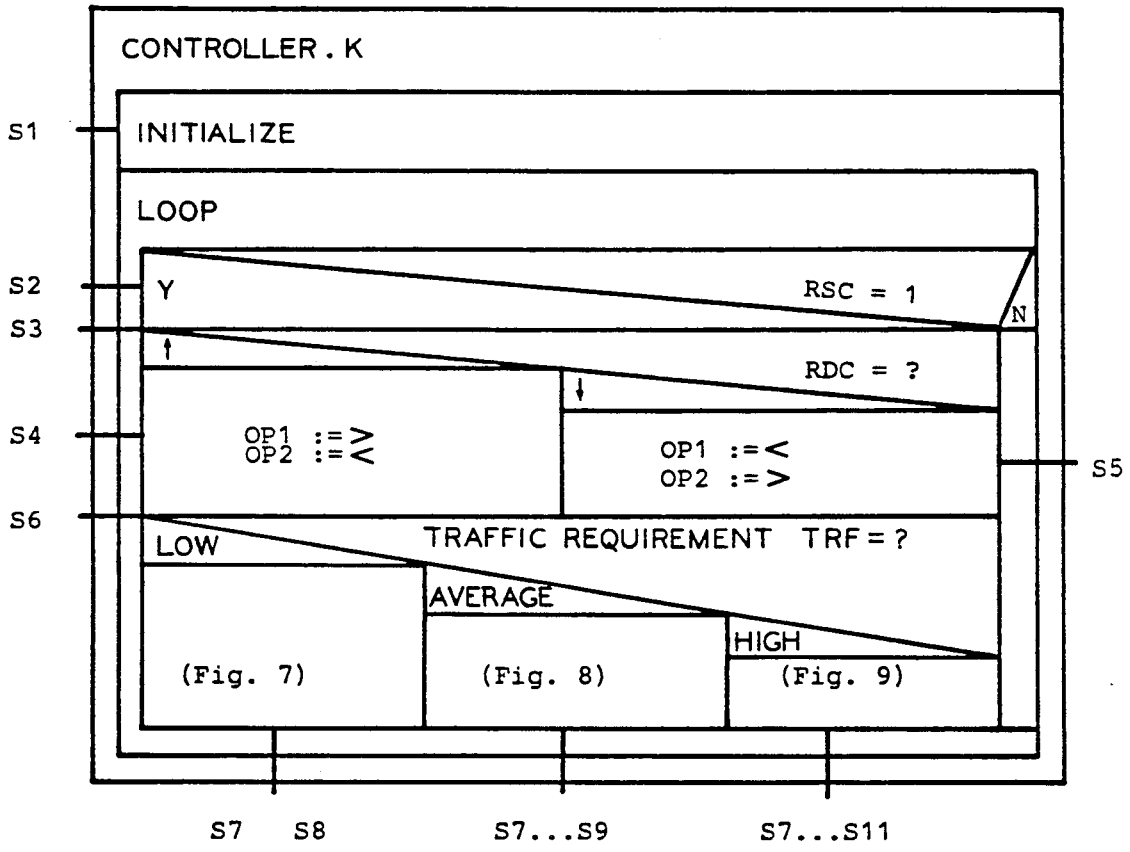
FIG. 6 is a flow diagram of an algorithm for the processing of car calls according to the present invention.

The FIG. 6 is a flow diagram of the sequential course of the algorithm CONTROLLER.K. In a step S1, all constants and variables used in the algorithm CONTROLLER.K are initialized. In a step S2, the algorithm CONTROLLER.K tests by means of the status variable data offer by car RSC, whether car calls DCC are present. On a positive result Y of the test, the elevator car offering the data is identified in a not illustrated step and the following steps relate to that identified elevator car. In a step S3, a selection procedure is served in dependence on the direction of travel RDC of the identified car. In the case of an upward travel characterized by an upward arrow, the comparison operator > is allocated to the operator one OP1 and the comparison operator < is allocated to the operator two OP2 in a step S4. In the case of a downward travel characterized by a downward arrow, the comparison operator < is allocated to the operator one OP1 and the comparison operator > is allocated to the operator two OP2 in a step S5. The allocation effected in the steps S4 and S5 is symbolized by the symbol :=.

The further processing of the car destination calls is dependent on the traffic volume TRF, which volume is tested for low, average or high values in the selection procedure illustrated in a step S6. In the case of low traffic volume TRF, the process is continued in the steps illustrated in the FIG. 7. The processing of the car destination calls DCC takes place according to the FIG. 8 in the case of average traffic volume TRF, and according to the FIG. 9 in the case of high traffic volume. In a further variant of the embodiment, not illustrated, a smaller graduation of the traffic volume can be provided in the selection procedure which will result in more than three test values.

Figure 7:
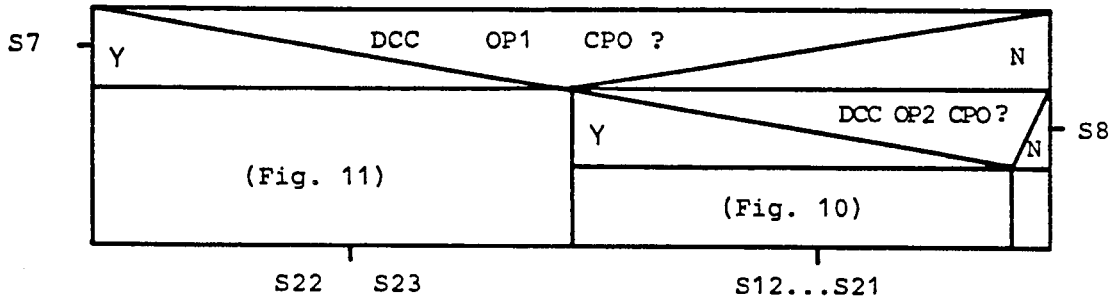
FIG. 7 is a continuation of the flow diagram of FIG. 6 for the processing of car calls in the case of low traffic volume.

The FIG. 7 is a flow diagram of the sequential course of the algorithm CONTROLLER.K for the processing of the car destination calls DCC in the case of a low traffic volume TRF. In a step S7, a test is conducted as to whether the car destination call DCC lies ahead of the elevator car in the direction of travel. The direction of travel is determined by the comparison operator allocated to the operator one OP1 in the steps S4 and S5. In the case of a positive result of the test, the processing of the car destination calls DCC is continued as shown in the FIG. 11. In a step S8, a test is conducted as to whether the car destination call DCC lies behind the elevator car in the direction of travel. By this repeated testing of the position of the car destination call DCC, cases in which the car destination call DCC is equal to the car position CPO are excluded. The direction of travel is determined by the comparison operator allocated to the operator OP2 in the steps S4 and S5. In the case of a positive result of the test, the processing of the car destination calls DGG is continued in the FIG. 10.

Figure 8:
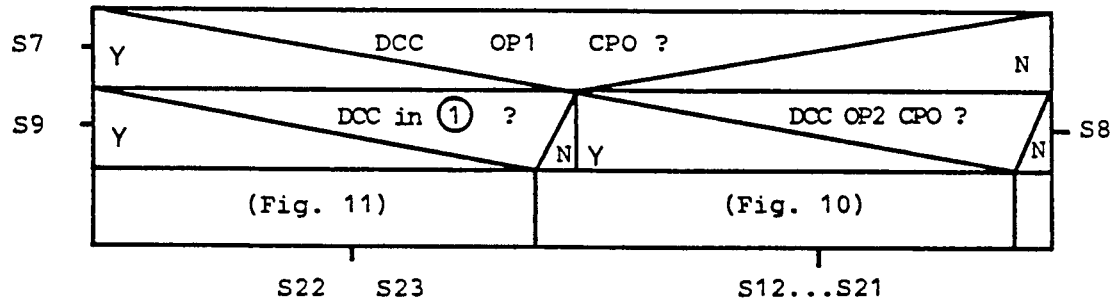
FIG. 8 is a continuation of the flow diagram of FIG. 6 for the processing of car calls in the case of average traffic volume.

The FIG. 8 is a flow diagram of the sequential course of the algorithm CONTROLLER.K for the processing of the car destination calls DCC in the case of average traffic volume TRF. The steps S7 and S8 are identical with the steps S7 and S8 of the FIG. 7. They are therefore not explained in more detail. In the case of a positive result of the test in the step 7, a further testing takes place in a step S9, in which a test is conducted as to whether any destination calls synonymous with the car destination call DCC have already been entered in the list Circle 1 of the current one hal round trip. In case any destination call has already been entered in the list Circle 1 for the destination floor denoted by DCC, the further processing of the car destination calls DCC takes place as shown in the FIG. 11. In the case of a negative result N of the test in the step S9, the processing of the car destination calls DCC is continued in the FIG. 10.

Figure 9:
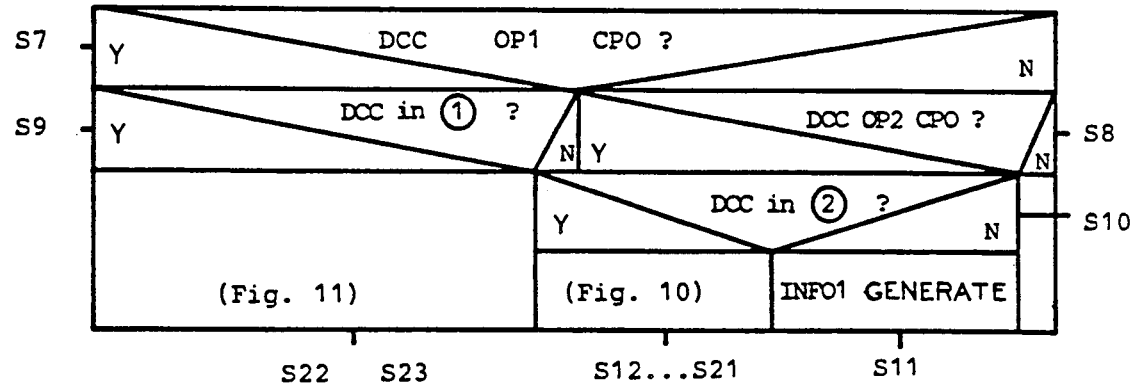
FIG. 9 is a continuation of the flow diagram of FIG. 6 for the processing of car calls in the case of high traffic volume.

The FIG. 9 is a flow diagram of the sequential course of the algorithm CONTROLLER.K for the processing of the car destination calls DCC in the case of high traffic volume TRF. The steps S7, S8 and S9 are identical with the steps S7, S8 and S9 of the FIG. 8. They are therefore not explained in more detail. In the case of a positive result of the test in the step S9, the further processing of the car destination calls DCC takes place as shown in the FIG. 11. In the case of a negative result of the test in the step S9, a further test takes place in a step S1O in which it is tested whether destination calls synonymous with the car destination call have already been entered in the list Circle 2 of the next one half round trip. In case destination calls have already been entered in the list for the destination floor denoted by DCC, the further processing of the car destination calls DCC takes place as shown in the FIG. 11. A negative result of the test in the step S1O is followed by a step S11 in which the user information INFO1 with the text "Call will not be served, please step out and enter call anew" is generated to the call indicating device of the elevator car.

Figure 10:
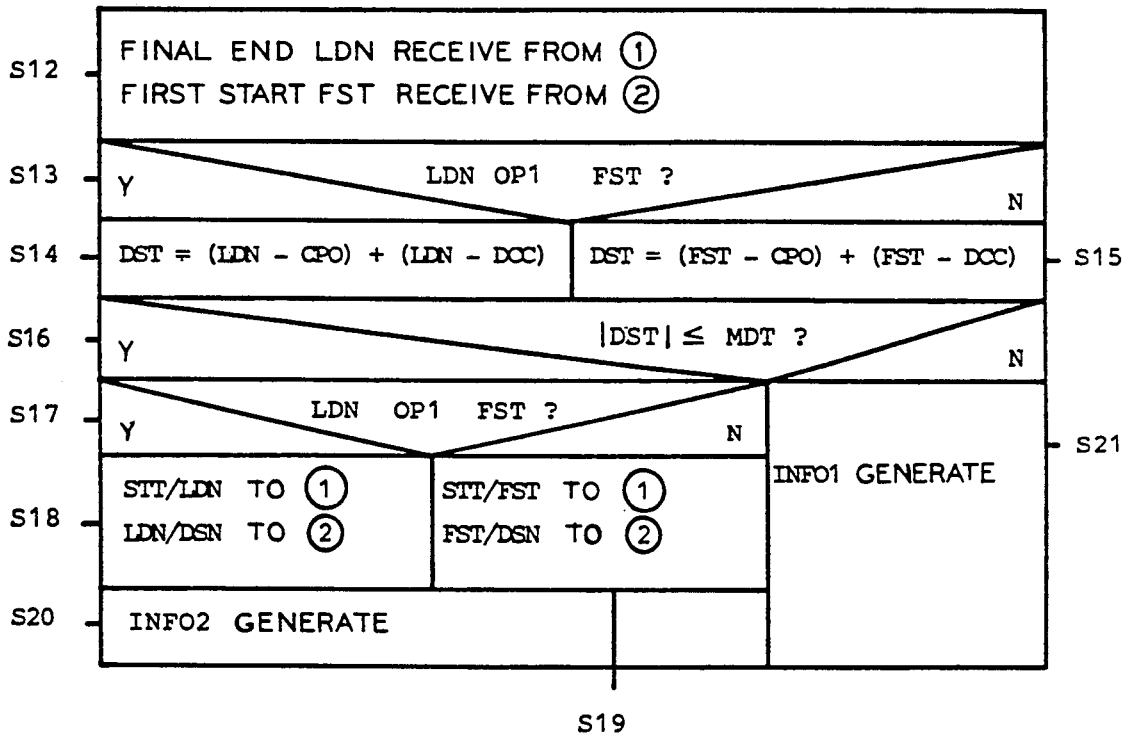
FIG. 10 is a continuation of the flow diagrams of FIGS. 7–9 for weighting and entering of car calls and for the generation of user information.

The FIG. 10 is a flow diagram of the sequential course of the algorithm CONTROLLER.K for the monitoring of the trip distance DST and for the entry of permissible trips into the list Circle 1 of the current one half round trip and into the list Circle 2 of the next one half round trip. In a step S12, the final end or last destination LDN entered in the list Circle 1 and the first start FST entered in the list Circle 2 are received. In a step S13, a test is conducted as to whether the last destination LDN of the list Circle 1 lies behind the first start FST of the list Circle 2. In the case of a positive result of the test in the step S13, there follows the computation of the trip distance DST according to the equation shown in a step S14. In that case, the trip distance DST is computed from the actual car position CPO by way of the last destination LDN to the destination floor desired by the car destination call DCC. In the case of a negative result of the test in the step S13, the computation of the trip distance DST takes place according to the equation shown in a step S15. In that case, the trip distance DST is computed from the actual car position CPO by way of the first start FST to the destination floor desired by the car destination call DCC.

If the test in a step S16 results in the trip distance DST being smaller than or equal in amount to a predetermined selectable maximum trip distance MDT, a test identical to the step S13 is performed in a step S17. In the case of a positive result of the test in the step S17, a trip in the form of Start/Last Destination STT/LDN is entered into the list Circle 1 and a trip in the form of Last Destination/Destination LDN/DSN is entered into the list Circle 2 in a step S18. In that case, the start STT corresponds to the actual car position CPO and the destination DSN corresponds to the car destination call DCC. In the case of a negative result in the test of the step S17, a trip in the form of Start/First Start STT/FST is entered into the list Circle 1 and a trip in the form of First Start/Destination FST/DSN is entered into the list Circle 2 in a step S19. In that case, the Start STT corresponds to the actual car position CPO and the destination DSN corresponds to the car destination call DCC. The steps S18 and S19 are followed by a step S20 in which the user information INF02 with the text "Call will be served in the opposite direction of travel" is generated to the call indicating device of the elevator car. A negative result of the test in the step S16 is followed by a step S1 in which the user information INFO1 with the text "Call will not be served, please step out and enter call anew" is generated to the indicating device of the elevator car.

Figure 11:
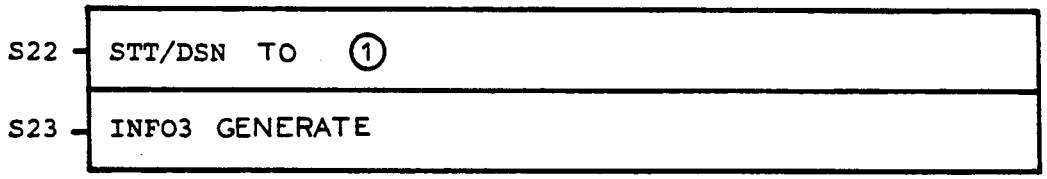
FIG. 11 is a continuation of the flow diagrams of FIGS. 7–9 for the entering of car calls and for the generation of user information.

The FIG. 11 is a flow diagram of the sequential course of the algorithm CONTROLLER.K for the entry of permissible trips into the list Circle 1 and for the generation of user information. In a step S22, a trip is entered in the form of Start/Destination STT/DSN into the list Circle 1 of the current one half round trip. A user information INF03 with the text "Call will be served" is generated to the call indicating device of the elevator car in a step S23.

In summary, the present invention concerns a method and apparatus for processing destination calls entered in call registering devices in elevator cars of an elevator group, the cars having elevator controls with immediate allocation of destination calls entered on the floors served by the cars. The method includes the steps of determining a value of the traffic volume of an elevator group from previously allocated destination calls; determining a trip distance from the position of a car destination call to be processed with respect to an elevator car of the elevator group in which the car destination call was entered; and comparing the car destination call with any destination calls allocated to the elevator car to determine coincidence. At a low traffic volume, if the car destination call lies ahead of the elevator car, the call is served unconditionally and, if the call lies behind the elevator car, the call is served if the trip distance is less than a predetermined maximum trip distance. At an average traffic volume, if the car destination call lies ahead of the elevator car, the call is served if the coincidence exists, and if the coincidence does not exist or the call lies behind the elevator car, the call is served if the trip distance is less than a predetermined maximum trip distance. At a high traffic volume, the car destination call is served only when the coincidence exists and the trip distance is less than a predetermined maximum trip distance.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method for processing destination calls entered in call registering devices in elevator cars of an elevator group, the cars having elevator controls with immediate allocation of destination calls entered on the floors served by the cars, comprising the steps of:

a. determining a value of the traffic volume of an elevator group from previously allocated destination calls by testing for at least low, average and high values of the traffic volume;

b. determining a trip distance from the position of a car destination call to be processed with respect to an elevator car of the elevator group in which said car destination call was entered;

c. comparing said car destination call with any destination calls allocated to the elevator car to determine coincidence; and d. determining whether and when said car destination call is to be served by the elevator car based upon said value of traffic volume, said trip distance and any coincidence of said car destination call with a destination call allocated to the elevator car.

2. The method according to claim 1 wherein when said traffic volume is low, if said car destination call lies ahead of the elevator car, said car destination call is served unconditionally and, if said car destination call lies behind the elevator car, said car destination call is served if said trip distance is less than a predetermined maximum trip distance.

3. The method according to claim 1 wherein when said traffic volume is average, if said car destination call lies ahead of the elevator car, said car destination call is served if said coincidence exists, and if said coincidence does not exist or said car destination call lies behind the elevator car, said car destination call is served if said trip distance is less than a predetermined maximum trip distance.

4. The method according to claim 3 wherein said car destination call lying ahead of the elevator car is served in a current one half round trip when said coincidence exists and is served in a next one half round trip when said coincidence does not exist.

5. The method according to claim 1 wherein when said traffic volume is high, said car destination call is served only when said coincidence exists and said trip distance is less than a predetermined maximum trip distance.

6. The method according to claim 5 wherein said car destination call lying ahead of the elevator car is served in a current one half round trip when said coincidence exists and said car destination call lying ahead or lying behind the elevator car is served in a next one half round trip when said coincidence exists.

7. The method according to claim 1 wherein said trip distance for trips over a one half round trip is calculated according to an equation $DST=(LDN-CPO)+(LDN-DCC)$, wherein LDN is the last destination of the current one half round trip, CPO is the actual position of the elevator car and DCC is said car destination call.

8. The method according to claim 1 wherein said trip distance for trips over a one half round trip is calculated according to the equation $DST=(FST-CPO)+(FST-DCC)$, wherein FST is the first start of the next half round trip. CPO is the actual position of the elevator and DCC is said car destination call.

9. The method according to claim 1 wherein said car destination call is registered as a trip in the form of start/destination floors in lists with the allocated destination calls of a current one half round trip and a next one half round trip.

10. The method according to claim 1 including a further step of generating a user information to a call indicating device of the elevator car.

11. An apparatus for processing destination calls entered in call registering devices in elevator cars of an elevator group, the cars having elevator controls with immediate allocation of destination calls entered on the floors served by the cars, comprising:

means for determining a value of the traffic volume of an elevator group from previously allocated destination calls by testing for at least low, average and high values of the traffic volume;

means for determining a trip distance from the position of a car destination call to be processed with respect to an elevator car of the elevator group in which said car destination call was entered;

means for comparing said car destination call with any destination calls allocated to the elevator car to determine coincidence; and means for determining whether and when said car destination call is to be served by the elevator car based upon said value of traffic volume, said trip distance and any coincidence of said car destination call with a destination call allocated to the elevator car.

12. The apparatus according to claim 11 wherein said means for determining a trip distance calculates to trips over a one half round trip according to an equation $DST=(LDN-CPO)+(LDN-DCC)$, wherein LDN is the last destination of the current one half round trip, CPO is the actual position of the elevator car and DCC is said car destination call.

13. The apparatus according to claim 11 wherein said means for determining a trip distance calculates for trips over a one half round trip according to the equation $DST=(FST-CPO)+(FST-DCC)$, wherein FST is the first start of the next half round trip, CPO is the actual position of the elevator and DCC is said car destination call.

14. The apparatus according to claim 11 including means for registering said car destination call as a trip in the form of start/destination floors in lists with the allocated destination calls of a current one half round trip and a next one half round trip.

15. The apparatus according to claim 14 wherein said means for registering generates a first list of trips for said current one half round trip and a second list of trips for said next one half round trip and at the end of said current one half round trip, clears said trips in said first list and transfers said trips in said second list to said first list.

16. The apparatus according to claim 11 including means for generating a user information to a call indicating device of the elevator car.

17. A method for processing destination calls entered in call registering devices in elevator cars of an elevator group, the cars having elevator controls with immediate allocation of destination calls entered on the floors served by the cars, comprising the steps:

a. selecting one of a plurality of predetermined values of the traffic volume of an elevator group based upon previously allocated destination calls;

b. determining a trip distance from the position of a car destination call to be processed with respect to an elevator car of the elevator group in which said car destination call was entered;

c. comparing said car destination call with any destination calls allocated to the elevator car to determine coincidence; and d. when said selected value represents low traffic volume, if said car destination call lies ahead of the elevator car, serving said car destination call unconditionally and, if said car destination call lies behind the elevator car, serving said car destination call if said trip distance is less than a predetermined maximum trip distance.

18. The method according to claim 17 including a step of, when said selected value represents average traffic volume, if said car destination call lies ahead of the elevator car, serving said car destination call if said coincidence exists, and if said coincidence does not exist or said car destination call lies behind the elevator car, serving said car destination call if said trip distance is less than a predetermined maximum trip distance.

19. The method according to claim 17 including a step of, when said traffic volume is high serving said car destination call only when said coincidence exists and said trip distance is less than a predetermined maximum trip distance.

* * * * *